United States Patent [19]

Ripka et al.

[11] 4,251,984

[45] Feb. 24, 1981

[54] APPARATUS FOR SEPARATING STAPLE FIBERS ON AN OPEN-END SPINNING UNIT

[75] Inventors: Josef Ripka; Vladimir Ohlidal, both of Usti n. Orl.; Vaclav Voborník, Letohrad; Jiri Elias, Brandys n. Orl.; Frantisek Jaros, Usti n. Orl.; Ctibor Doudlebsky, Usti n. Orl.; Jan Junek, Usti n. Orl.; Zdenék Kotrba, Usti n. Orl.; Marie Brozková, Usti n. Orl.; Ludmila Lihtarová, Usti n. Orl., all of Czechoslovakia

[73] Assignee: Vyzkumny ustav bavlnarsky, Usti nad Orlici, Czechoslovakia

[21] Appl. No.: 57,017

[22] Filed: Jul. 12, 1979

[30] Foreign Application Priority Data

Jul. 20, 1978 [CS] Czechoslovakia ..... 4845-78

[51] Int. Cl.[3] ..... D01H 7/895; D01H 7/892

[52] U.S. Cl. ..... 57/58.91; 57/58.95

[58] Field of Search ..... 57/58.89–58.95; 19/105

[56] References Cited

U.S. PATENT DOCUMENTS

| | | | |
|---|---|---|---|
| 3,381,463 | 5/1968 | Fajt et al. | 57/58.91 X |
| 3,571,859 | 3/1971 | Doudlebsky et al. | 57/58.91 X |
| 3,775,956 | 12/1973 | Rajnoha et al. | 57/58.91 |
| 3,884,029 | 5/1975 | Ripka et al. | 57/58.91 |
| 3,938,310 | 2/1976 | Didek et al. | 57/58.91 |
| 3,998,040 | 12/1976 | Ripka et al. | 57/58.95 |
| 4,067,182 | 1/1978 | Jaros et al. | 57/58.95 |

*Primary Examiner*—Donald Watkins

[57] ABSTRACT

Apparatus for separating cotton type staple fibers from a fibrous sliver supplied to an open-end rotor spinning machine, said apparatus having a surface for supporting the so-called fiber beard of the sliver to be attacked by a card clothing of the combing cylinder. The dimensions and position of said support surface relative to the sliver feeding means and said card clothing are defined in dependence on the count of the sliver as well as on the gauge and staple length of the fibers to be processed. Such an optimization of the support surface dimensions and position makes it possible to attain an excellent evenness of fiber separation and consequently a good final yarn quality even with relatively low speeds of the combing cylinder, and also to reduce the risk of card clothing damage.

4 Claims, 3 Drawing Figures

APPARATUS FOR SEPARATING STAPLE FIBERS ON AN OPEN-END SPINNING UNIT

Figure 1:
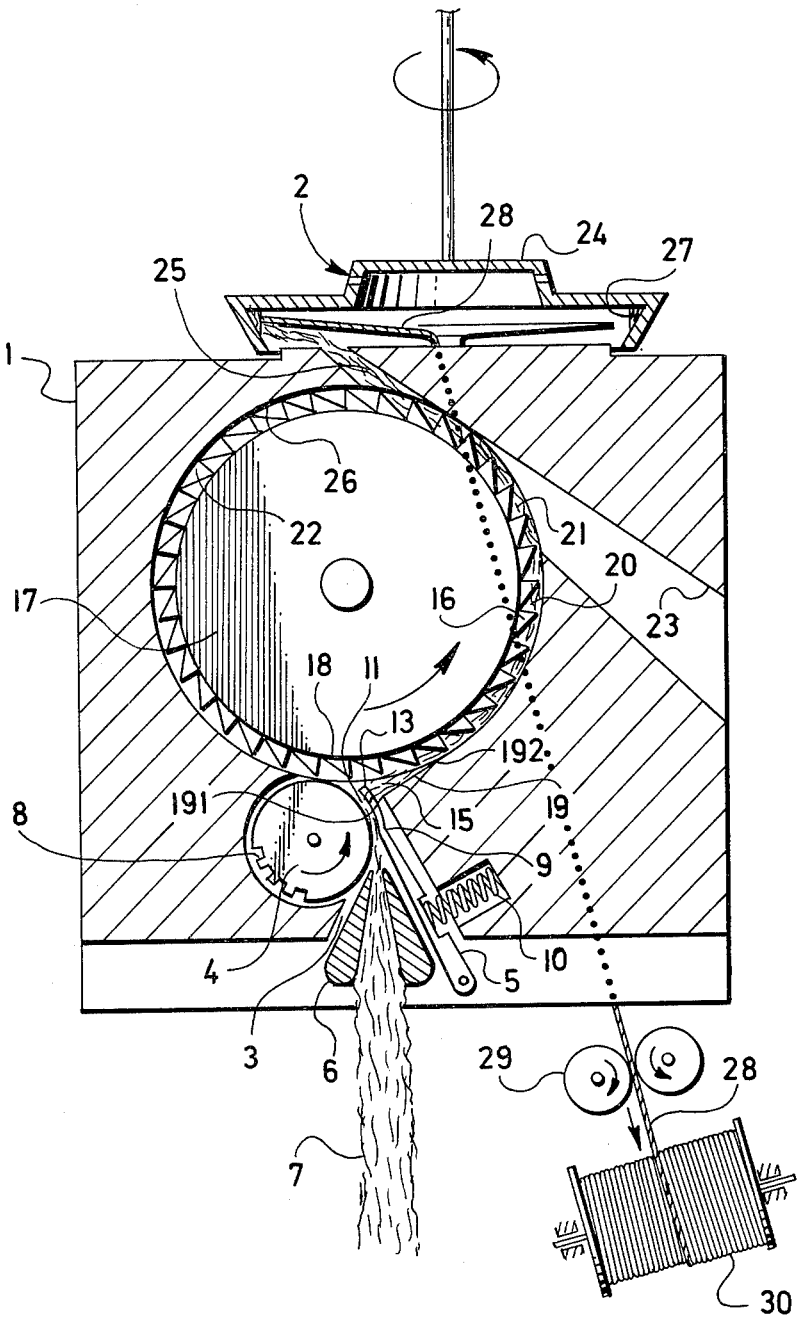

The present invention relates to an apparatus for separating cotton type staple fibers from a fibrous sliver in an open-end spinning unit.

Fiber separating devices operating upon the combing cylinder principle have been the subject of a number of improvements. Particular attention has been paid to the fiber separating, sliver feeding and fiber stripping zones, respectively, the operations of which are influenced, above all, by the geometry of the fiber supply duct.

The invention particularly relates to the zone of separating fibers from a fiber beard of sliver, and its object is to improve the geometry of said fiber separating region, and particularly with the embodiment of a known open-end spinning unit known as the BD 200 machine, which is the first to have been provided with regulation of the so-called position A, which means the position of the presser shoe trough. Downstream of this position an invariable, fixed fiber beard supporting surface has been provided. Such embodiment is disclosed in Czechoslovakian Pat. No. 140,587. By regulating this position A by means of an eccentric pin it has been made possible to obtain various geometric relationships between the presser shoe trough-from the clothing at the distance of 3.4 mm, while the central angle corresponding to the beard supporting surface is 41°, which corresponds to an untensioned beard length of 28.6 mm. A disadvantage of such an arrangement has resulted from the ascertained fact that during the fiber separating process the fibers tend to be severed, viz. shortened in staple length.

In an endeavor to improve the geometry of the fiber separating zone by way of making the separating process less harsh in its treatment of the fibers, attempts have been made to provide various elements for regulating the support surface position (see e.g. Czechoslovakian inventor's certificats Nos. 152,577, 152,575, 152,576, and 163,568). Among the disadvantages encountered with such arrangements are the complexity of the mechanical arrangement, expensiveness of the spinning unit and of the regulation or exchangeable elements in the fiber separating region, relative high demands as to accuracy of manufacture as well as, even with a high quality thereof, a risk of fiber snappings and tuft formation which impair the separating process and evenness of the fiber flow on its way to the twist forming element.

When using the aforementioned arrangement for processing fibers having a gauge of more than 1.5 dtex, it has been found that the applied geometry does not correspond to the requisite evenness of separation of such fibers. To eliminate this drawback, there has been proposed in the Czechoslivakian inventor's certificate No. 165,855 an optimum range of geometry of the support surface relative to the fiber gauge and to the average staple length. It, however, has been ascertained that this range is suitable for processing rather relatively coarse wool type fiber having a gauge of more than 2 dtex and a staple length of more than 40 mm.

The known geometrical constructions of the fiber separating zone for the spinning units of open-end spinning machines operating at speeds of 60,000 r.p.m. and more, have proved incapable of ensuring an evenness of separated fiber supply and such a degree of fiber separation that corresponds to the production of yarn of required quality, and particularly as far as evenness and strength are concerned. Because of the formation of unseparated fiber agglomerations, all of the afore-mentioned arrangements have been found to be objectionable.

It has been ascertained that, from the viewpoint of the fiber separation quality, it is relevant correctly to define the fiber beard supporting surface, and particularly the distance of its initial edge from the outer cylinder surface of the combing cylinder, i.e. the edge adjacent the recess of the presser shoe fork, as well as to define the intersection edge of said support surface, viz. the final line thereof most closely approaching the combing cylinder.

The initial edge is defined by a distance thereof from the cylindrical surface of the combing cylinder provided with a sawtooth, needle or the like card clothing. The position of the intersection edge is defined by the distance between said initial edge and said intersection edge of the support surface, and by the fact that said intersection edge lies on the inner wall of the cavity receiving the combing cylinder, which wall is in close proximity to an imaginary surface circumscribed by the points of card clothing elements of said cylinder.

Such a definition has its logical reasons, since the firstmentioned distance defines also, relative to the height of the active card clothing elements, the degree of interaction between the fiber beard of the sliver and the card clothing of the combing cylinder because it is above all this interaction upon which depend the value of pressure forces and consequently that of frictional forces manifesting themselves in the fiber tooth contact.

The second distance determines the fiber beard length exposed to the gradually increasing action of the active card clothing elements upon the fibers.

It has been found out that only with an appropriate combination of the afore-mentioned distances relative to the fineness of sliver as well as to the gauge and staple length of fibers it is composed of, is it possible to establish optimum conditions of fiber separation, and particularly not only from the viewpoint of the fiber supply and consequently final yarn evenness, but also of a mild treatment of fibers in respect to their length and straightness. These conditions positively influence the high quality, especially strength, of final yarn.

Thus it is an object of the present invention to determine fundamental geometric parameters of the support surface for the fiber beard of the sliver to be opened in relation to the fineness of said sliver and the actual staple length of cotton or cotton type fibers to be processed, said staple length varying within the range of from 15 to 40 mm while the fiber gauge reaches 2.2 dtex.

The apparatus of the invention fulfills the above object. In such apparatus, the distance of the initial edge of the support surface from the cylindrical outer wall of the combing cylinder from which fiber separating elements project falls within the range of $$H-(1.5 \text{ to } 2.2)\cdot T_{to\ ktex} \quad \text{(mm)}$$

while at the same time the distance of the initial edge from the intersection edge corresponds to the relation of $$G = (2.3 \text{ to } 4.2)\cdot\sqrt[3]{l_v\,\text{mm}} \quad \text{(mm)}$$

The optimization of the above values H and G results in excellent fiber separation evenness and yarn quality even with relatively low combing cylinder speeds, and is of a considerable importance with regard to the reduction of card clothing element wear and of the risk of fiber dustiness and damage.

Figure 2:
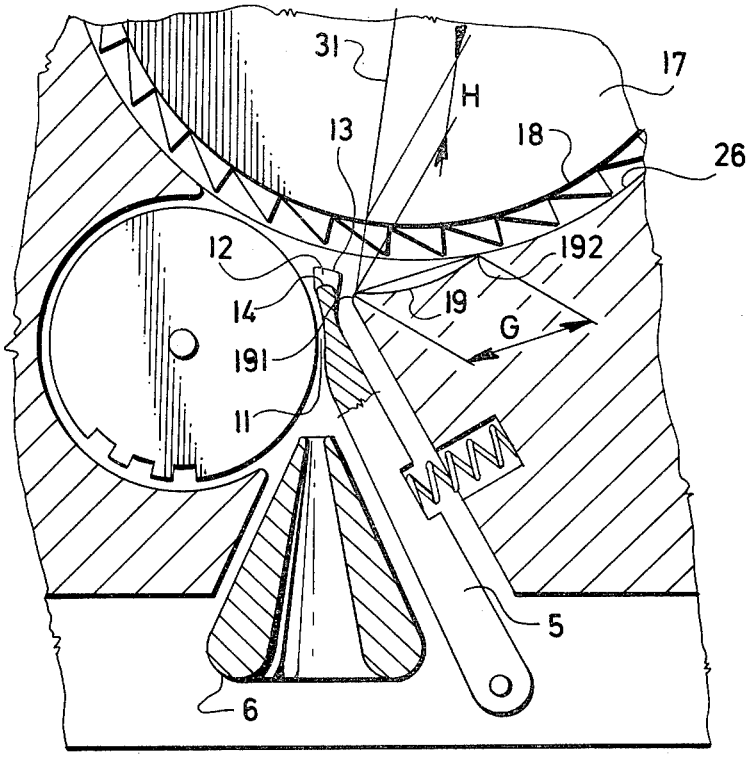
Figure 3:
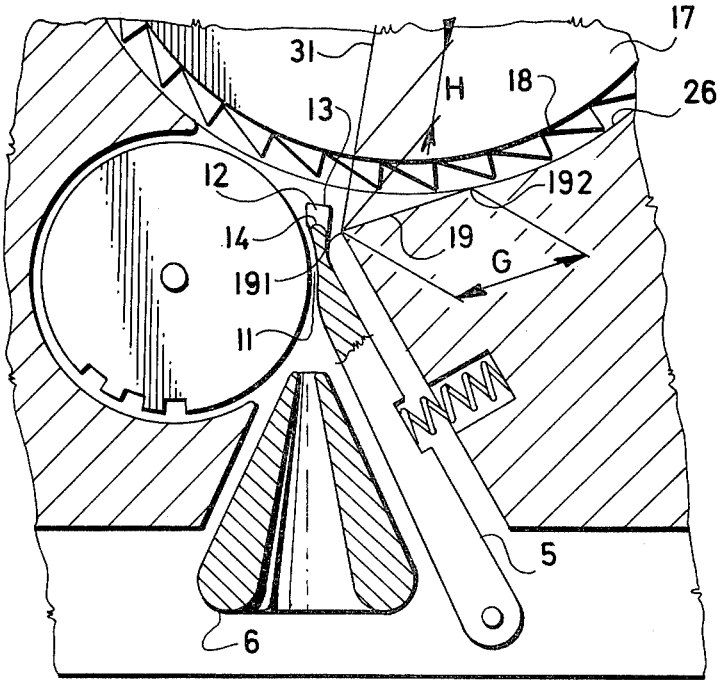

Some preferred embodiments of the invention will be hereafter described with reference to the accompanying schematic drawings in which FIG. 1 is a view in axial section of an open-end spinning unit with a spinning rotor;

FIG. 2 is a detailed view of the fiber separating device of the unit, showing the geometrical parameters of a cylindrical support surface for the fiber beard; and FIG. 3 is a fragmentary view similar to FIG. 2 but showing the geometrical parameters of a planar support surface for the fiber board.

FIG. 1 serves for a general description of a open-end spinning unit and for defining the fundamental terms of the individual parts thereof. Principally, the open-end spinning unit comprises a fiber separating device 1 and a twist forming element 2. The former consists of a sliver feeding mechanism 3 comprising a feed roller 4 and a presser shoe 5 which may support a condenser funnel 6 for modeling the cross-section of the sliver 7 supplied. The feed roller 4 has a fluted or roughened surface 8 to which the sliver 7 is forced by the trough 9 of the presser shoe 5, due to the action of a spring 10. Downstream of a nip line 11 between the feed roller 4 and the presser shoe 5, the sliver 7 is passed through a recess 12 of a fork 13 of said shoe 5. The sliver 7 is then bent over a rounded edge 14 of said recess 12 and is converted into a fiber beard 15 which is attacked by a card clothing such as teeth 16 projecting from the cylindrical surface 18 of a rotary combing cylinder 17.

During the rotation of the combing cylinder 17, the teeth 16 exert a pressure on the fiber beard bearing on a support surface 19. By impact and friction force effects the teeth 16 exerted on fibers 20 forming the beard 15, said fibers 20 are released from the beard; this process is called "fiber separation". The separated fibers 20 of fiber groups 21 are further conveyed to a fiber supply duct 23 by the clothing 22 (e.g. teeth 16 or the like) of the combing cylinder 17 as well as by air flow parallel to the direction of rotation of the combing cylinder 17, said duct 23 being designed for supplying air from the ambient atmosphere and for transporting fibers into a spinning rotor 24. The fiber supply duct 23 intersects, in the region 25 of stripping fibers 20 from the clothing 22, a cylindrical cavity 26 receiving the combing cylinder 17. In the spinning rotor 24, the fibers 20 are then converted in well-known way into a fiber ribbon 27 which is twisted to yarn 28 withdrawn by take-off rollers 29 and wound onto a bobbin 30.

FIG. 2 illustrates the sliver feeding and the fiber separating region of the open-end spinning unit more in detail, said figure particularly showing the elements of the fiber beard supporting surface 19. The support surface 19 has an initial edge 191 in proximity to the recess 12 of the fork 13 of the presser shoe 5, and an intersection edge 192 comprised within the circle showing the wall of the cylindrical cavity 26. The initial edge 191 of the support surface 19 is spaced from the cylindrical surface 18 of the combing cylinder 17 by a distance H intercepted on a radial line 31. The distance between the initial edge 191 and the intersection edge 192 of the support surface 19 is indicated by G.

It is an object of the present invention to determine optimum geometric conditions by appropriately combining the dimensions H and G.

The dimension H is given, in a certain range, by the relation $$H=(1.5 \text{ to } 2.2)\cdot T_{to\ ktex} \quad \text{(mm)}$$

From this relation it is possible to calculate the actual quantity H by introducing a numerical value of sliver count expressed in ktex into such equation.

Thus, for example, a sliver is to be processed the count of which being $T_{to}=4000$ tex$=T_{to\ ktex}=4$ ktex. When the value 4 is introduced into the equation, the optimum H value proves to be $$H=(1.5 \text{ to } 2.2)\cdot 4=(6 \text{ to } 8.8) \text{ mm}$$

It is evident that the dimension H consists of the height of the active elements of the clothing 22 and of the actual depth of the support surface extending into the cavity 26.

Apart from the value H, it is necessary to determine the dimension G which is given by the relation $$G = (2.3) \text{ to } 4.2)\sqrt[3]{l_v \text{ mm}} \quad \text{(mm)}$$

From this relation it is possible to calculate the dimension G in mm by substituting a numerical value for $l_v$ in mm. The symbol $l_v$ stands for the staple length of cotton or man-made fibers to be processed; in case of a blend, $l_v$ equals a mean value derived from one or more length characteristics, depending upon the number of blend components.

Thus, for instance, for the sake of simplicity let $l_v=27$ mm; then $$G = (2.3 \text{ to } 4.2)\sqrt[3]{27} = (2.3 \text{ to } 4.2)\cdot 3 = (6.9 \text{ to } 12.6) \text{ mm}$$

The shape of the support surface 19 can be, in general, as shown in FIG. 2, cylindrical but is preferably planar as shown in FIG. 3.

It has been ascertained that for cotton fibers and blends of man-made fibers with cotton within the range of staple lengths $l_v=15$ to 40 mm and of a gauge of up to 2.5 dtex, contained in a sliver of count $T_{to\ ktex}$ within the range of from 2 to 5 ktex, the optimum lengths of the dimensions H and G are $$H=6.5 \text{ mm}$$

$$G=12.0 \text{ mm}$$

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In an apparatus for separating cotton type staple fibers having a staple length $l_v=15$ to 40 mm and a gauge of up to 2.5 dtex from a fibrous sliver having a count $T_{to\ ktex}$ of from 2 to 5 ktex in an open-end spinning unit comprising a combing cylinder with a card clothing, a feed roller and a presser shoe bearing on said roller, the combing cylinder being received in a cavity the cylindrical inner wall of which merges into a support surface for guiding a fiber beard of said sliver, said support surface, which extends towards said feed roller and said presser shoe, being defined by an initial edge at its side adjacent the presser shoe, and by an intersection edge in the region of intersection with said cylindrical inner wall of said cavity, the improvement wherein the distance (H) of the initial edge of the support surface from the cylindrical outer wall of the combing cylinder from which the fiber separating elements project is comprised within the range of:

$$H=(1.5 \text{ to } 2.2)\cdot T_{to\ ktex} \quad \text{(mm)}$$

the distance (G) of the initial edge from the intersection edge corresponding to the relation:

$$G = (2.3 \text{ to } 4.2)\cdot\sqrt[3]{1_{\nu}\,\text{mm}} \quad \text{(mm)}$$

2. Apparatus as claimed in claim 1, wherein the support surface corresponds to the constant universal geometric parameters of H=6.5 and G=12.0 mm.

3. Apparatus as claimed in claim 1, wherein the support surface is of cylindrical configuration.

4. Apparatus as claimed in claim 1, wherein the support surface is of planar configuration.

* * * * *